US010738731B2

(12) United States Patent
Riffe et al.

(10) Patent No.: US 10,738,731 B2
(45) Date of Patent: Aug. 11, 2020

(54) MONOLITHIC, GALLERYLESS PISTON AND METHOD OF CONSTRUCTION THEREOF

(71) Applicant: Federal-Mogul Corporation, Southfield, MI (US)

(72) Inventors: Jeff Riffe, Troy, MI (US); Michael Weinenger, Southfield, MI (US)

(73) Assignee: Tenneco Inc., Lake Forest, IL (US)

( * ) Notice: Subject to any disclaimer, the term of this patent is extended or adjusted under 35 U.S.C. 154(b) by 461 days.

(21) Appl. No.: 14/988,885

(22) Filed: Jan. 6, 2016

(65) Prior Publication Data

US 2016/0115899 A1 Apr. 28, 2016

Related U.S. Application Data

(63) Continuation-in-part of application No. 14/940,416, filed on Nov. 13, 2015, which is a continuation of (Continued)

(51) Int. Cl.

| | |
|---|---|
| ***F02F 3/00*** | (2006.01) |
| ***F02F 3/22*** | (2006.01) |
| ***F02F 3/16*** | (2006.01) |

(52) U.S. Cl.

CPC ..... *F02F 3/0084* (2013.01); *F02F 3/00* (2013.01); *F02F 3/0069* (2013.01); (Continued)

(58) Field of Classification Search

CPC .... F02F 2003/0007; F02F 3/00; F02F 3/0069; F02F 3/0084; F02F 3/0092; F02F 3/16; F02F 3/22; Y10T 29/49265

See application file for complete search history.

(56) References Cited

U.S. PATENT DOCUMENTS

| | | | |
|---|---|---|---|
| 4,704,950 | A | 11/1987 | Ripberger et al. |
| 6,772,846 | B1 | 8/2004 | Scharp |

(Continued)

FOREIGN PATENT DOCUMENTS

| | | | |
|---|---|---|---|
| JP | S58142313 | U | 9/1983 |
| JP | S61058954 | A | 3/1986 |

(Continued)

OTHER PUBLICATIONS

International Search Report, dated Mar. 13, 2017 (PCT/US2017/012113).

(Continued)

*Primary Examiner* — Lindsay M Low
*Assistant Examiner* — Ruben Picon-Feliciano
(74) *Attorney, Agent, or Firm* — Robert L. Stearns; Dickinson Wright, PLLC

(57) ABSTRACT

A galleryless steel piston for an internal combustion engine is provided. The piston has a monolithic piston body including an upper wall forming an upper combustion surface with first and second portions. The first portion extends annularly along an outer periphery of the upper wall and the second portion defines a combustion bowl. The piston further includes undercrown surface located directly opposite the combustion bowl with an exposed 2-dimensional surface area allowing for contact of cooling oil. The exposed 2-dimensional surface area ranges from 25 to 60 percent of a cross-sectional area defined by a maximum outer diameter of the piston body. To further enhance cooling, a portion of the undercrown surface is concave or convex, such that oil is channeled during reciprocation of the piston from one side to the opposite side of the piston.

18 Claims, 7 Drawing Sheets

Related U.S. Application Data application No. 14/535,839, filed on Nov. 7, 2014, now Pat. No. 9,869,268.

(60) Provisional application No. 62/011,876, filed on Jun. 13, 2014, provisional application No. 61/901,287, filed on Nov. 7, 2013.

(52) U.S. Cl.
CPC ..... *F02F 3/0092* (2013.01); *F02F 3/16* (2013.01); *F02F 3/22* (2013.01); *F02F 2003/0007* (2013.01); *Y10T 29/49265* (2015.01)

(56) References Cited

U.S. PATENT DOCUMENTS

| | | | | |
|---|---|---|---|---|
| 6,840,156 | B1 | 1/2005 | Gillman et al. | |
| 6,860,190 | B2 | 3/2005 | Oversby et al. | |
| 6,938,603 | B2 | 9/2005 | Scharp | |
| 7,240,643 | B1 * | 7/2007 | Perr | F01P 3/08 123/41.35 |
| 7,249,577 | B1 * | 7/2007 | Zhang | F01M 1/06 123/41.35 |
| 8,434,333 | B2 | 5/2013 | Zhang et al. | |
| 9,869,268 | B2 * | 1/2018 | Riffe | F02F 3/16 |
| 2004/0261612 | A1 | 12/2004 | Gillman et al. | |
| 2008/0034691 | A1 | 2/2008 | Rasmussen | |
| 2008/0105118 | A1 | 5/2008 | Frank et al. | |
| 2008/0216790 | A1 | 9/2008 | Breidenbach et al. | |
| 2011/0073061 | A1 * | 3/2011 | Chae | F02F 3/0076 123/193.6 |
| 2013/0032120 | A1 | 2/2013 | Claver et al. | |
| 2013/0118438 | A1 | 5/2013 | Lineton | |
| 2013/0233270 | A1 * | 9/2013 | Brandt | F02F 3/0076 123/193.6 |
| 2015/0122212 | A1 | 5/2015 | Riffe et al. | |

FOREIGN PATENT DOCUMENTS

| | | | |
|---|---|---|---|
| JP | S63074560 | U | 5/1988 |
| JP | 2006214298 | A | 8/2006 |
| JP | 2007500608 | A | 1/2007 |
| JP | 2007309477 | A | 11/2007 |
| JP | 2010509529 | A | 3/2010 |
| KR | 20090064187 | A | 6/2009 |
| WO | 2007135534 | A2 | 11/2007 |

OTHER PUBLICATIONS

International Search Report, dated Feb. 20, 2015 (PCT/US2014/064582).

* cited by examiner

MONOLITHIC, GALLERYLESS PISTON AND METHOD OF CONSTRUCTION THEREOF

CROSS-REFERENCE TO RELATED APPLICATIONS

This U.S. Continuation-In-Part Application claims the benefit of U.S. Continuation patent application Ser. No. 14/940,416, filed Nov. 13, 2015, which claims the benefit of U.S. Utility patent application Ser. No. 14/535,839, filed Nov. 7, 2014, which claim the benefit of U.S. Provisional Application No. 61/901,287, filed Nov. 7, 2013, and the benefit of U.S. Provisional Application No. 62/011,876, filed Jun. 13, 2014, which are each incorporated herein, by reference, in their entirety.

BACKGROUND OF THE INVENTION

1. Technical Field

This invention relates generally to internal combustion engines, and more particularly to pistons therefor.

2. Related Art

Engine manufacturers are encountering increasing demands to improve engine efficiencies and performance, including, but not limited to, improving fuel economy, reducing oil consumption, improving fuel systems, increasing compression loads and operating temperatures within the cylinder bores, reducing heat loss through the piston, improving lubrication of component parts, decreasing engine weight and making engines more compact, while at the same time decreasing the costs associated with manufacture.

While desirable to increase the compression load and operation temperature within the combustion chamber, it remains necessary to maintain the temperature of the piston within workable limits. Accordingly, although desirable to increase the compression load and operation temperature within the combustion chamber, achieving this goal comes with a tradeoff in that these desirable "increases" limit the degree to which the piston compression height, and thus, overall piston size and mass can be decreased. This is particularly troublesome with typical piston constructions having a closed or partially closed cooling gallery to reduce the operating temperature of the piston. The cost to manufacture pistons having upper and lower parts joined together along a bond joint to form the closed or partially closed cooling gallery is generally increased due to the joining process used to bond the upper and lower parts together. Further, the degree to which the engine weight can be reduced is impacted by the need to make the aforementioned "cooling gallery-containing" pistons from steel so they can withstand the increase in mechanical and thermal loads imposed on the piston.

SUMMARY OF THE INVENTION

One aspect of the invention provides a piston for an internal combustion engine designed to improve engine efficiency and performance. The piston is free of a cooling gallery along and undercrown surface and thus has a reduced weight and related costs, relative to known piston constructions, but still provides for exceptional cooling to maintain the temperature of the piston within workable limits. The piston comprises a piston body extending along a central longitudinal axis. The piston body has an upper wall forming an upper combustion surface and an annular ring belt depending from the upper combustion surface. The upper combustion surface has first and second portions, the first portion extends annularly along an outer periphery of the upper wall, and the second portion forms a combustion bowl depending radially inwardly from the first portion. The piston body further includes a pair of skirt panels depending from the ring belt, and a pair of pin bosses spaced from one another by the skirt panels providing a pair of laterally spaced pin bores. The undercrown surface is formed on an underside of the upper wall and is located opposite the second portion of the upper combustion surface, radially inwardly of the ring belt. The undercrown surface has an exposed 2-dimensional surface area, as viewed looking along the central longitudinal axis, ranging from 25 to 60 percent of a cross-sectional area defined by a maximum outer diameter of the piston body.

Another aspect of the invention provides a method of constructing a piston which is free of a cooling gallery along an undercrown surface. The method comprises forming a piston body extending along a central longitudinal axis by at least one of machining, forging, and casting. The piston body has an upper wall forming an upper combustion surface and an annular ring belt depending from the upper combustion surface. The upper combustion surface has first and second portions, the first portion extends annularly along an outer periphery of the upper wall, and the second portion forms a combustion bowl depending radially inwardly from the first portion. The piston body further includes a pair of skirt panels depending from the ring belt, and a pair of pin bosses spaced from one another by the skirt panels providing a pair of laterally spaced pin bores. The undercrown surface is formed on an underside of the upper wall and is located opposite the second portion of the upper combustion surface, radially inwardly of the ring belt. The undercrown surface has an exposed 2-dimensional surface area, as viewed looking along the central longitudinal axis, ranging from 25 to 60 percent of a cross-sectional area defined by a maximum outer diameter of the piston body.

BRIEF DESCRIPTION OF THE DRAWINGS

These and other aspects, features and advantages of the invention will become more readily appreciated when considered in connection with the following detailed description of presently preferred embodiments and best mode, appended claims and accompanying drawings, in which:

DETAILED DESCRIPTION

Figure 1:
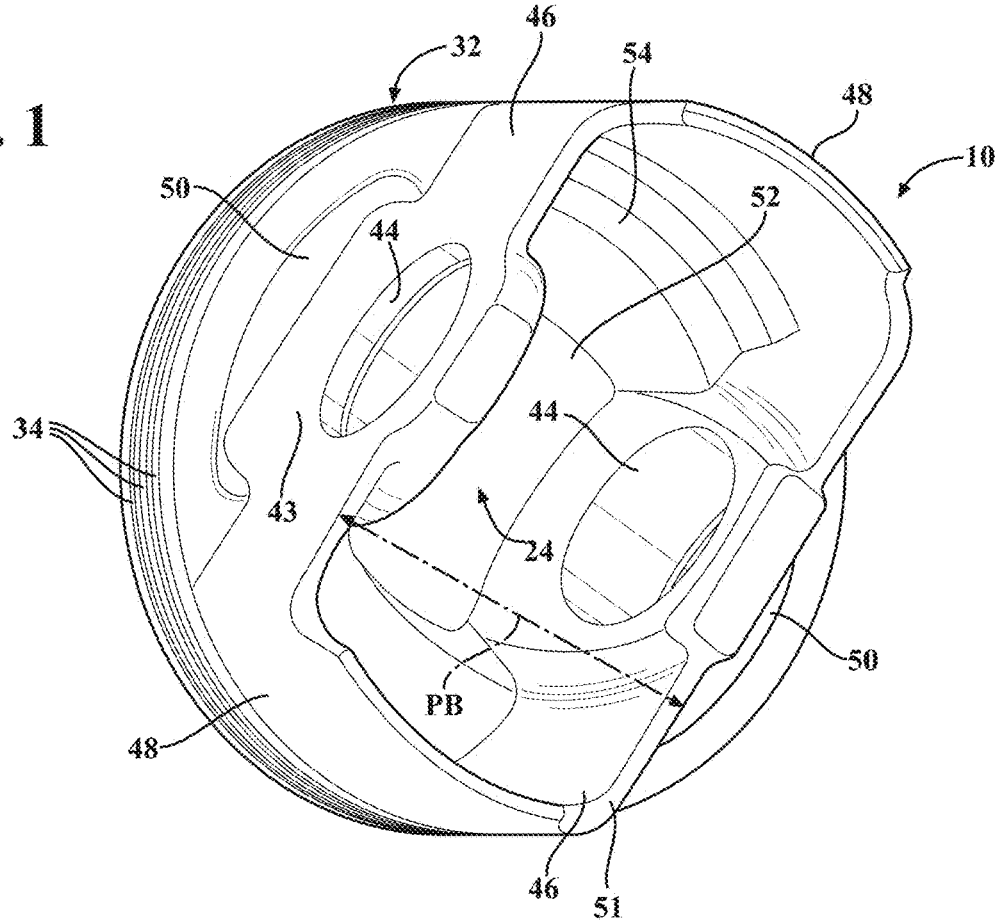
FIG. 1 is a bottom perspective view of a piston constructed in accordance with an example embodiment of the invention, wherein the piston includes a concave portion along the undercrown surface.
Figure 2:
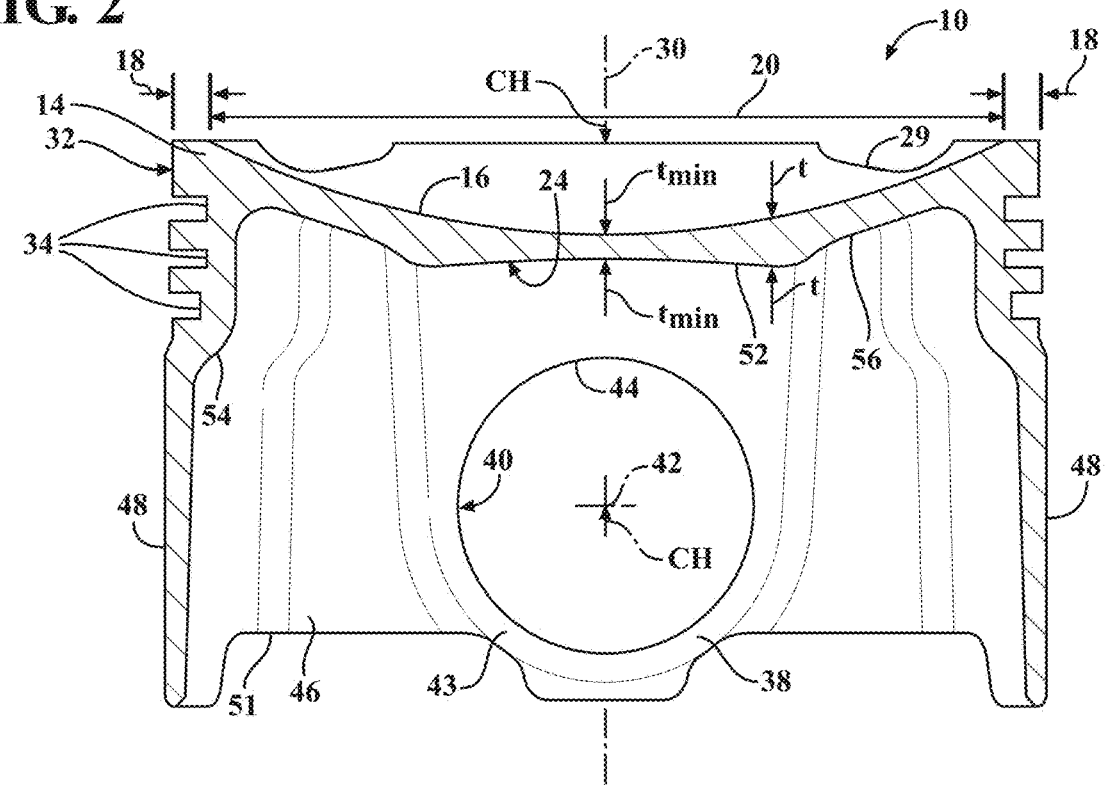
FIG. 2 is a cross-sectional view taken generally transversely to a pin bore axis of a piston in accordance with an embodiment of the invention.
Figure 3:
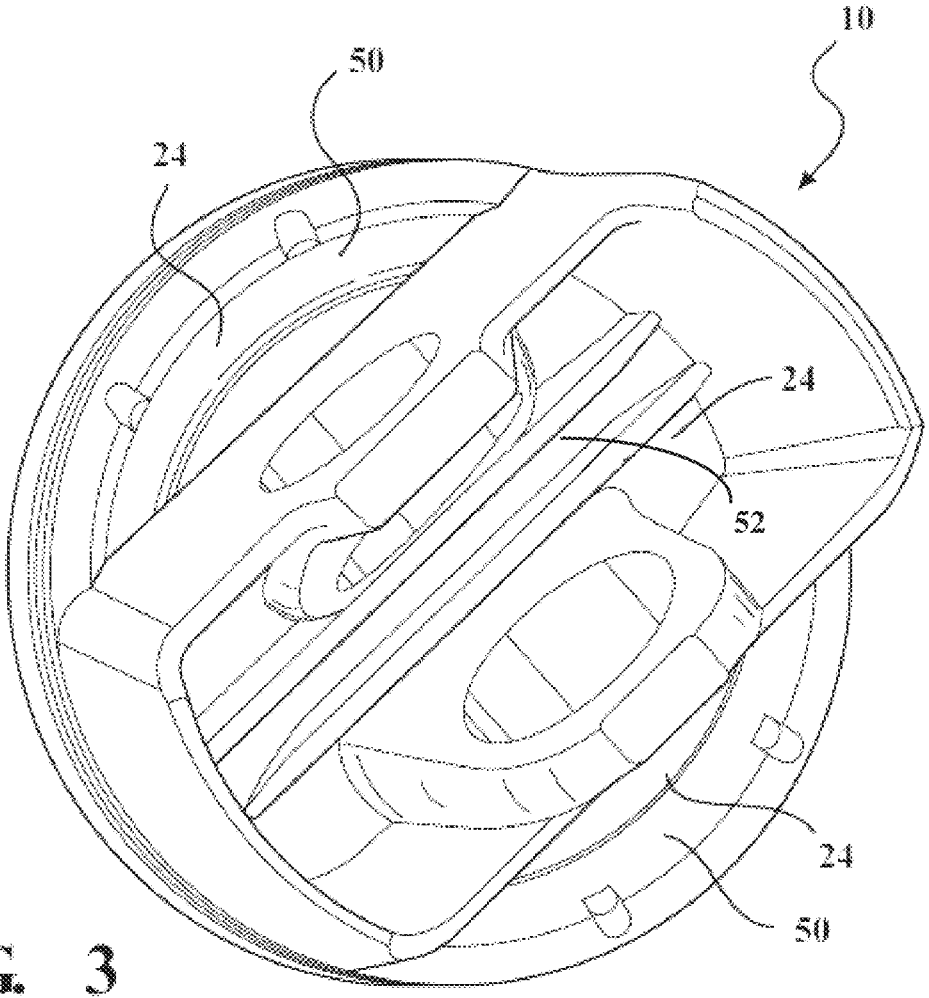
FIG. 3 is a bottom perspective view of a piston constructed in accordance with another example embodiment of the invention.
Figure 4:
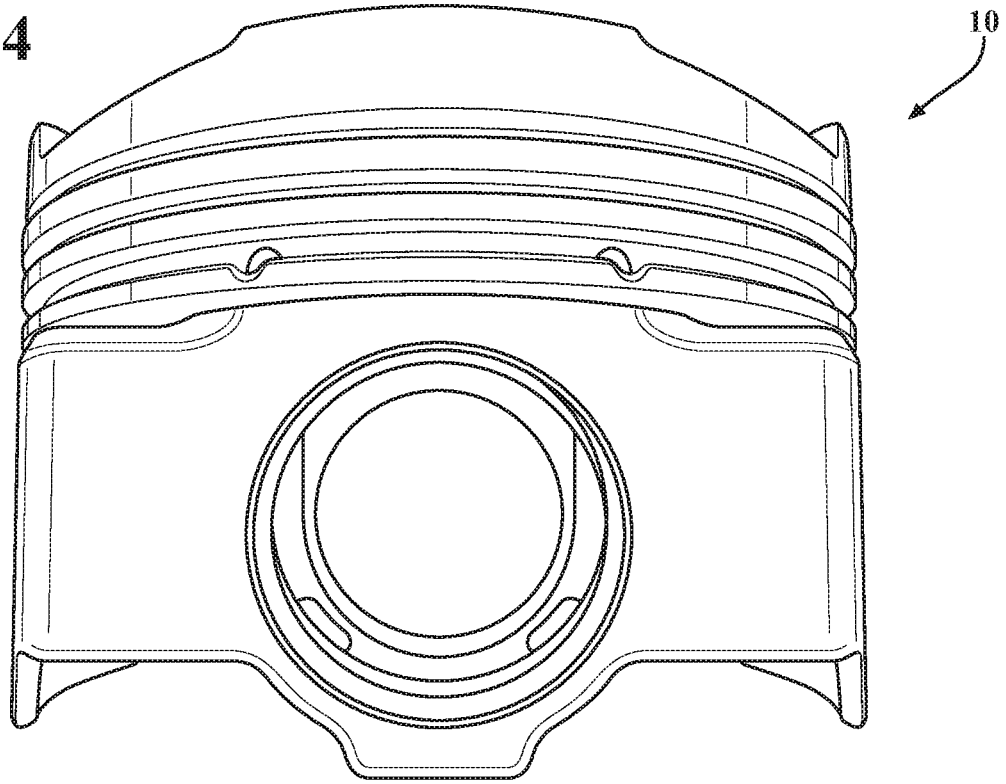
FIG. 4 is a side view of a piston constructed in accordance with yet another example embodiment of the invention.
Figure 5:
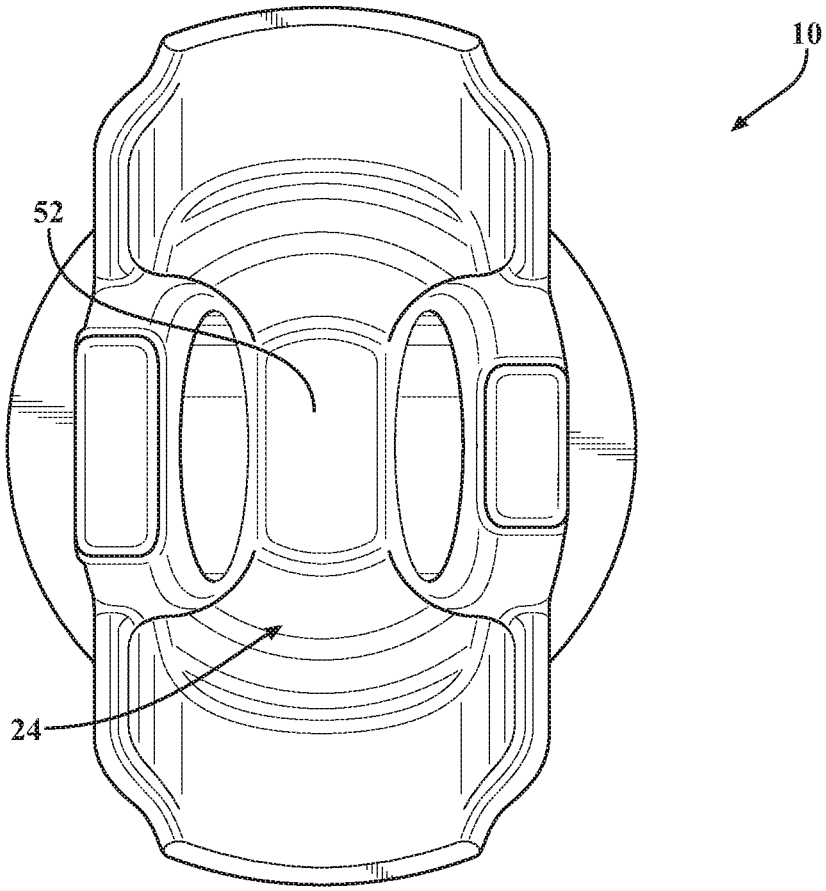
FIG. 5 is a bottom view of the piston of FIG. 4.

Referring in more detail to the drawings, FIGS. 1-13 illustrate views of a piston 10 constructed in accordance with example embodiments of the invention for reciprocating movement in a cylinder bore or chamber (not shown) of an internal combustion engine, such as a modern, compact, high performance vehicle engine, for example. The piston 10 is constructed having a monolithic body formed from a single piece of material, such as via machining, forging or casting, with possible finish machining performed thereafter, if desired, to complete construction. Accordingly, the piston 10 does not have a plurality of parts joined together, such as upper and lower parts joined to one another, which is commonplace with pistons having enclosed or partially enclosed cooling galleries bounded or partially bounded by a cooling gallery floor. To the contrary, the piston 10 is "galleryless" in that it does not have a cooling gallery floor or other features bounding or partially bounding a cooling gallery. The piston body, being made of steel, is strong and durable to meet the high performance demands, i.e. increased temperature and compression loads, of modern day high performance internal combustion engines. The steel (i.e., the steel alloy) used to construct the body can be SAE 4140 grade or different, depending on the requirements of the piston 10 in the particular engine application. Due to the piston 10 being galleryless, and the novel configuration of the body, among other things discussed below, minimizes the weight and compression height (CH) of the piston 10, thereby allowing an engine in which the pistons 10 are deployed to achieve a reduced weight and to be made more compact. Further yet, even though being galleryless, the novel construction discussed below and shown in the Figures allows the piston 10 to be sufficiently cooled during use to withstand the most severe operating temperatures.

The piston body has an upper head or top section providing an upper wall 14, which provides an upper combustion surface 16 that is directly exposed to combustion gasses within the cylinder bore of the internal combustion engine. The upper combustion surface 16 includes an annular first portion 18 formed as a substantially planar surface extending along an outer periphery of the upper wall 14 and a second portion 20 forming a combustion bowl. The second portion 20 of the upper combustion surface 16, which forms the combustion bowl, typically has a non-planar, concave, or undulating surface that depends from the planar first portion 18.

The piston 10 also includes an undercrown surface 24 formed on an underside of the upper wall 14, directly opposite the second portion 20 of the upper combustion surface 16 and radially inwardly of the ring belt 32. The undercrown surface 14 is preferably located at a minimum distance from the combustion bowl and is substantially the surface on the direct opposite side from the combustion bowl. The undercrown surface 24 is defined here to be the surface that is visible, excluding the pin bores 40, when observing the piston 10 straight on from the bottom.

The undercrown surface 24 can also be defined in view of a thickness t of the upper wall 14. The thickness t of the upper wall 14 extends from the upper combustion surface 16 to the underside of the upper wall 14. The portion of the underside of the upper wall 14 which is considered to be the undercrown surface 24 is typically a portion that is located a certain distance away from the second portion 20 of the upper combustion surface 16, and that distance is no more than two times the minimum thickness t of the upper wall 14 along the second portion 20. The undercrown surface 24 can also be define as a portion of the underside of the upper wall 14 which is located at a distance not greater than 10 mm away from the upper combustion surface 16. Accordingly, the undercrown surface 24 is generally form fitting to the combustion bowl of the upper combustion surface 16. The undercrown surface 24 is also openly exposed, as viewed from an underside of the piston 10, and it is not bounded by an enclosed or partially enclosed cooling gallery, or any other features tending to retain oil or a cooling fluid near the undercrown surface 24.

The annular first portion 18 of the upper wall 14 forms an outer periphery of the upper wall 14 and surrounds the second portion forming the combustion bowl, which depends therefrom. Thus, the second portion 20, including the combustion bowl, is recessed below the uppermost first portion 18 of the upper combustion surface 16. The combustion bowl of the second portion 20 also extends continuously through a central axis 30 and across the entire diameter of the piston 10, between opposite sides of the annular first portion 18. The combustion bowl typically comprises a concave surface extending continuously between the opposite sides of the annular first portion 18. Alternatively, the combustion bowl wall can be contoured, for example to provide an upper apex, also referred to as center peak (not shown), which may lie coaxially along the central axis 30 of the piston 10, or may be axially offset relative to the piston central axis 30. The top section of the piston 10 further includes a ring belt 32 that depends from the upper combustion surface 16 to provide one or more ring grooves 34 for receipt of one or more corresponding piston rings (not shown). In the example embodiments, at least one valve pocket 29 having a curved profile is formed in the annular first portion 18 of the upper wall 14. The combustion bowl does not include the valve pockets 29.

The piston body further includes a bottom section including a pair of pin bosses 38 depending generally from the upper wall 14. The pin bosses 38 each have a pin bore 40, preferably bushingless given the steel construction, wherein the pin bores 40 are laterally spaced from one another coaxially along a pin bore axis 42 that extends generally transversely to the central longitudinal axis 30. The pin bosses 38 have generally flat, radially outermost surfaces, referred to as outer faces 43, that are spaced from one another along the pin bore axis 40 a distance PB, shown as being generally parallel with one another. The PB dimension is minimized, thereby maximizing an exposed area of a recessed, generally cup-shaped region, referred to hereafter as undercrown pockets 50.

The undercrown pockets 50 are located radially outwardly of the pin bosses 38 and at least a portion of each pocket 50 forms a portion of the undercrown surface 24. In the example embodiment, the portions of the undercrown pockets 50 forming the portion of the undercrown surface 24 are located opposite the second portion 20 of the upper combustion surface 16 and radially inwardly of the ring belt 32, at a distance of no more than two times a minimum thickness of the upper wall 14, and at a distance of not greater than 10 mm from the upper combustion surface 16.

The undercrown pockets 50 also extend radially outwardly beyond the undercrown surface 24 along an underside surface of the annular first portion 18 of the upper combustion surface 16 and depend from the upper wall 14 along an inner surface of the ring belt 32. These portions of the undercrown pockets 50 are either located outwardly of the second portion 20 of the upper combustion surface 16, at a distance of greater than two times a minimum thickness of the upper wall 14, and/or at a distance of greater than 10 mm from the upper combustion surface 16, and thus they do not form a portion of the undercrown surface 24.

With the 2-dimensinional and 3-dimensional surface area of the pockets 50 being maximized, at least in part due to the minimized distance PB, the cooling caused by oil splashing or being sprayed upwardly from the crankcase against the exposed surface of the undercrown pockets 50 is enhanced, thereby lending to further cooling of the upper combustion surface 16, the undercrown surface 24, as well as a portion of the ring belt 34.

The pin bores 40 each have a concave uppermost load bearing surface, referred to hereafter as uppermost surface 44, disposed near the ring belt 32. As such, the compression height CH is minimized (the compressing height is the dimension extending from the pin bore axis 42 to the upper combustion surface 16). The pin bosses 38 are joined via outer panels, also referred to as struts 46, to diametrically opposite skirt panels, also referred to as skirt panels 48.

The pin bosses 38, skirt panels 48 and struts 46 bound an open region extending from a lowermost or bottom surface 51 of the struts 46 and skirt panels 48 to the undercrown surface 24. In the embodiments of FIGS. 1, 2, and 4-13, no ribs are located along the undercrown surface 24, along the pin bosses 38, along the skirt panels 48, or along the struts 46 in the open region. In addition, no closed or partially closed cooling gallery is formed in the open region. However, the piston 10 can include a stepped region 54 along the uppermost edge of each skirt panel 48 adjacent the undercrown surface 24, as identified in FIGS. 1 and 2. In the example embodiments of FIGS. 1 and 2, the stepped regions 54 are not considered part of the undercrown surface 24. In another embodiment, for example the embodiment shown in FIG. 3, the piston 10 does include a pair of ribs 58 along the undercrown surface 24 to enhance cooling. These ribs 58 extend continuously along the undercrown surface 24 between the opposite skirt panels 38.

The open region along the underside of the piston 10 provides direct access to oil splashing or being sprayed from within the crankcase directly onto the undercrown surface 24, thereby allowing the entire undercrown surface 24 to be splashed directly by oil from within the crankcase, while also allowing the oil to freely splash about the wrist pin (not shown), and further, significantly reduce the weight of the piston 10. Accordingly, although not having a typical closed or partially closed cooling gallery, the generally open configuration of the galleryless piston 10 allows optimal cooling of the undercrown surface 24 and lubrication to the wrist pin joint within the pin bores 40, while at the same time reducing oil residence time on the surfaces near the combustion bowl, which is the time in which a volume of oil remains on the surface. The reduced residence time can reduce unwanted build-up of coked oil, such as can occur in pistons having a closed or substantially closed cooling gallery. As such, the piston 10 remains "clean" over extended use, thereby allowing it to remain substantially free of build-up.

Owing to the optimal cooling of the undercrown surface 24 is the percentage of the undercrown surface 24 directly underlying the upper combustion surface 16 that is directly exposed to the splashing and sprayed oil from the crankcase. The undercrown surface 24 of the piston 10 has greater a total surface area (3-dimensional area following the contour of the surface) and a greater projected surface area (2-dimensional area, planar, as seen in plan view) than comparative pistons having a closed or partially closed cooling gallery.

The total exposed surface area, defined as the 3-dimensional area $A_{u3D}$ following the contour of the undercrown surface 24, is an expansive area for contact by cooling oil while the piston 10 is in use. In the example embodiments, the 3-dimensional area $A_{u3D}$ of the undercrown surface 24 is greater than 30 percent of, and typically ranges from 40 to 90 percent of a cross-sectional area $A_{OD}$ defined by the maximum outer diameter OD of the piston 10.

The undercrown surface 24 can also have a projected surface area, defined as the 2-dimensional surface area $A_{u2D}$ seen looking generally along the central longitudinal axis 30 from the bottom of the piston 10 of greater than 25 percent, and typically ranging from 30 to 60 percent of the cross-sectional area defined by the maximum outer diameter OD of the piston 10. More preferably, the 2-dimensional surface area $A_{u2D}$ ranges from 30 to 55 percent of the cross-sectional area defined by the maximum outer diameter OD of the piston 10. As indicated above, a portion of the 2-dimensional surface area $A_{u2D}$ of the undercrown surface 24 is located within the pockets 50. The 2-dimensional surface area $A_{u2D}$ of the undercrown surface 24 can also be measured relative to the 2-dimensional surface area $A_{c2D}$ of the combustion bowl along the upper combustion surface 16. In the example embodiments, the 2-dimensional surface area $A_{u2D}$ of the undercrown surface 24 ranges from 50 to 125 percent of the 2-dimensional surface area $A_{c2D}$ of the combustion bowl. In addition, the valve pockets 29 are not included in the 2-dimensional surface area $A_{c2D}$ of the combustion bowl.

The 3-dimensional surface area $A_{u3D}$ of the undercrown surface 24 can also be measured relative to the 3-dimensional surface area $A_{c3D}$ of the combustion bowl along the upper combustion surface 16. In the example embodiments, the 3-dimensional surface area $A_{u3D}$ of the undercrown surface 24 ranges from 50 to 120 percent of the 3-dimensional surface area $A_{c3D}$ of the combustion bowl. As indicated above, a portion of the 3-dimensional surface area $A_{u3D}$ of the undercrown surface 24 is located within the pockets 50.

Figure 6:
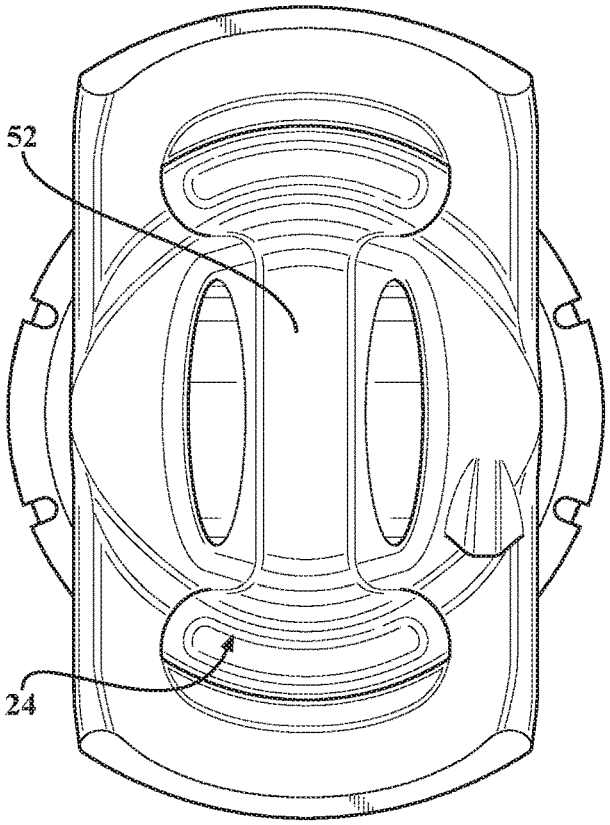
FIG. 6 is a bottom view of the piston of FIG. 4 according to another example embodiment.
Figure 7:
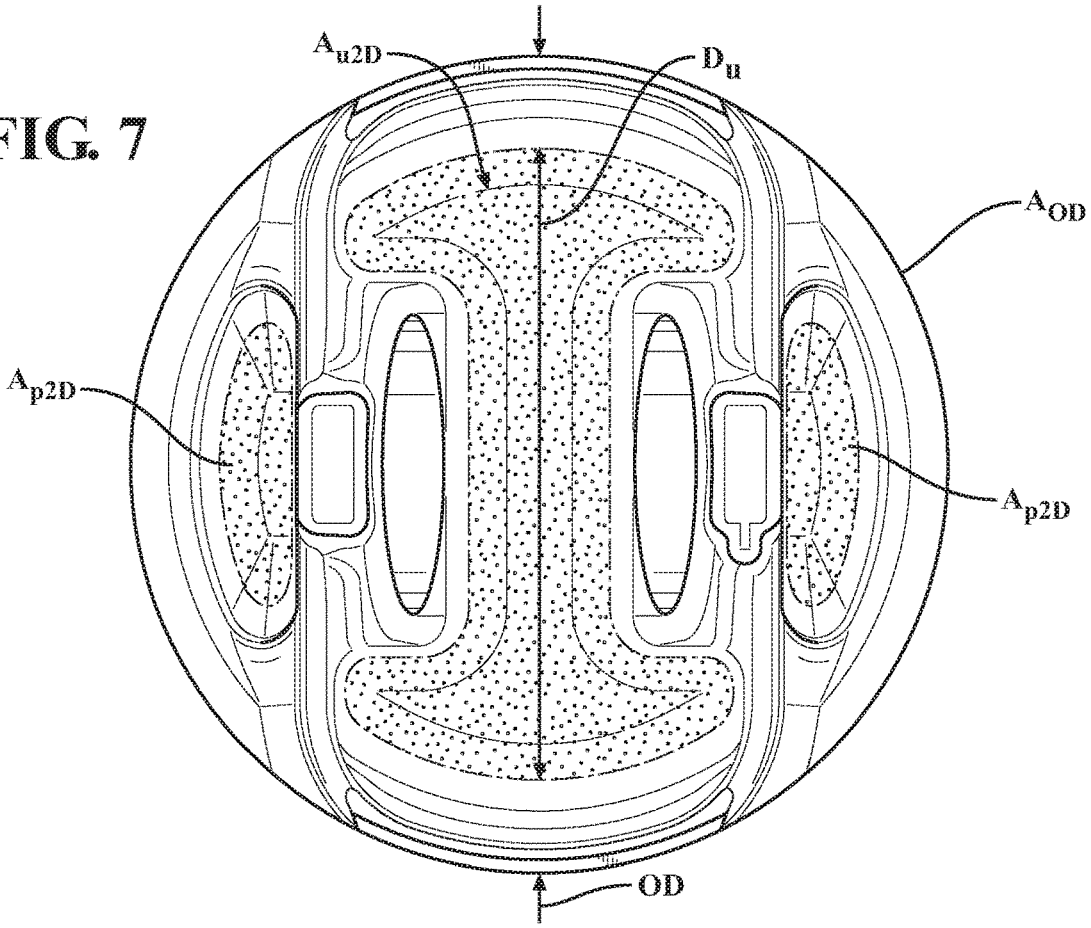
FIG. 7 illustrates the 2-dimensional undercrown surface area of the piston shown in FIG. 6.
Figure 8:
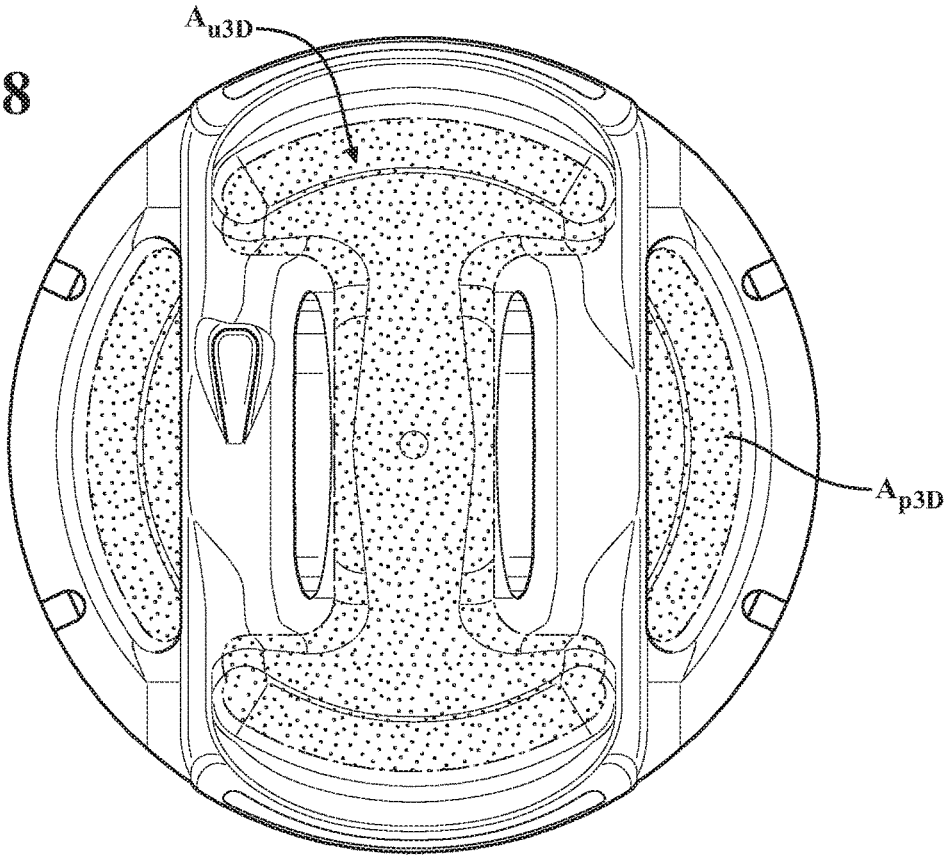
FIG. 8 illustrates the 3-dimensional undercrown surface area of the piston shown in FIG. 6.
Figure 9:
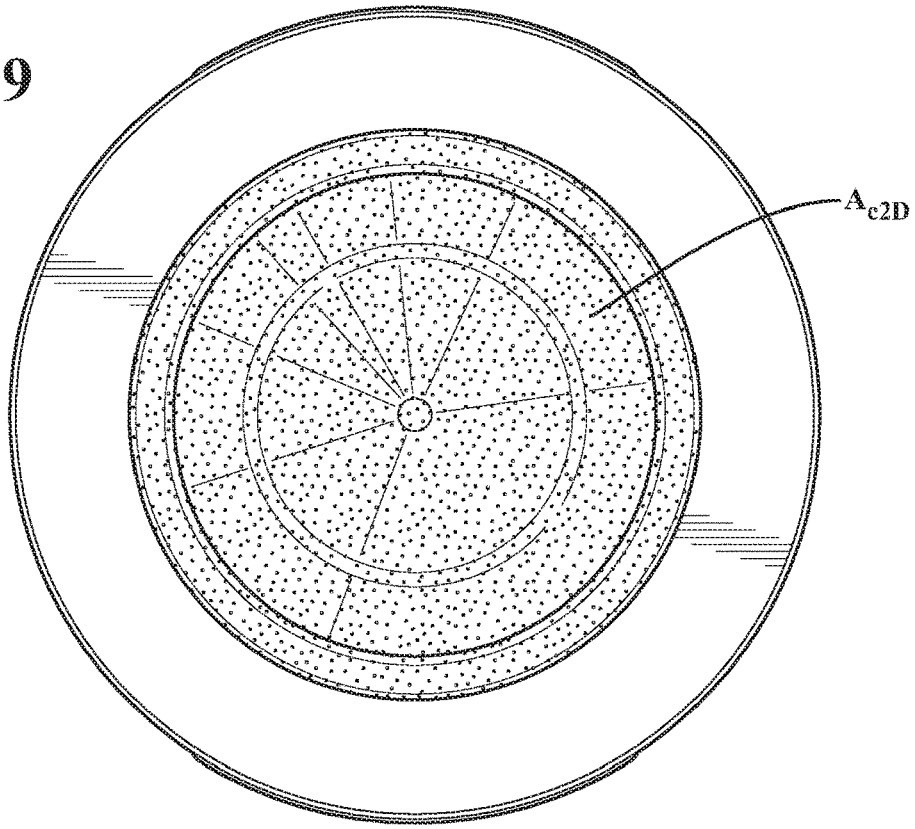
FIG. 9 illustrates the 2-dimensional surface area of the combustion bowl of the piston shown in FIG. 6.
Figure 10:
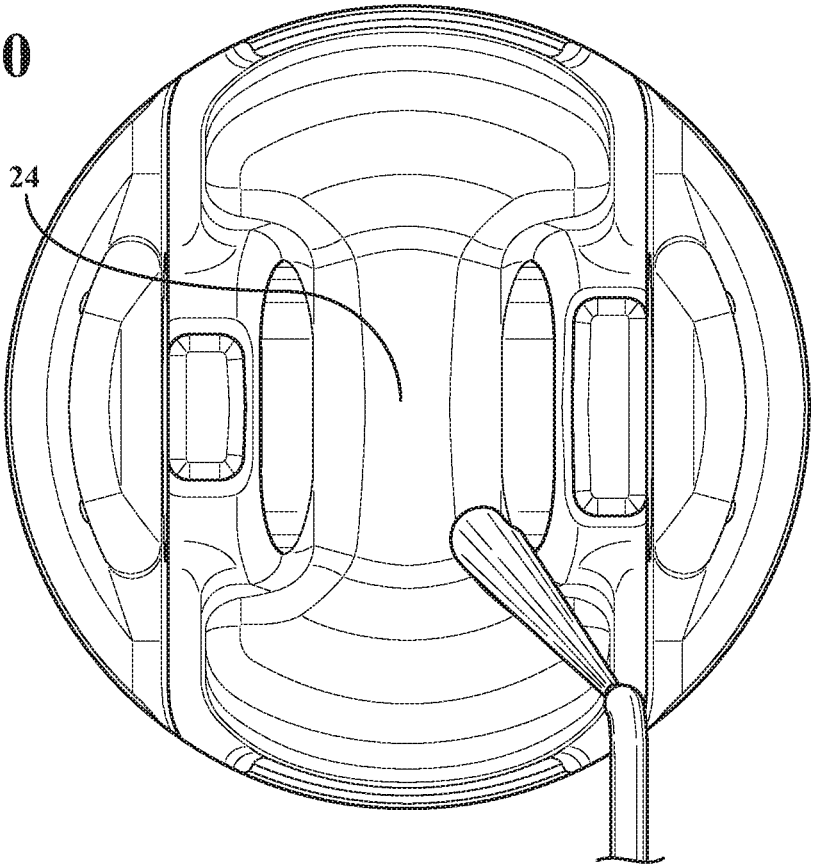
FIG. 10 illustrates oil being sprayed onto the undercrown surface of the piston shown in FIG. 6 at a top dead center position.
Figure 11:
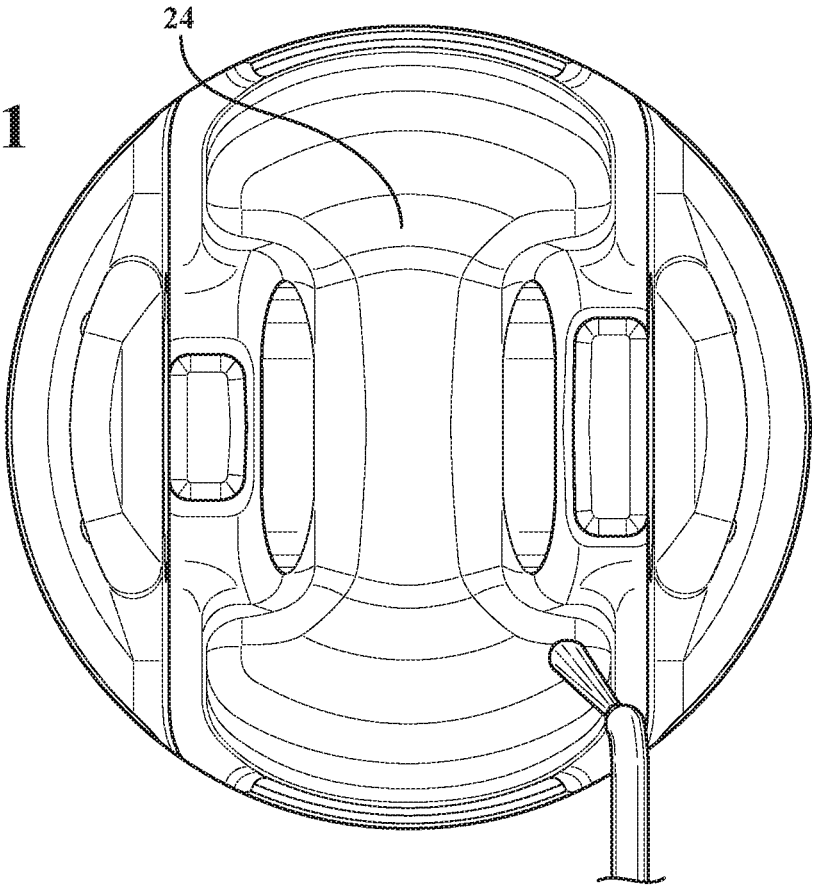
FIG. 11 illustrates oil being sprayed onto the undercrown surface of the piston shown in FIG. 6 at a bottom dead center position.

As an example, FIG. 7 identifies the outer diameter OD and the 2-dimensional surface area $A_{u2D}$ of the undercrown surface 24 of the piston 10 of FIG. 6; FIG. 8 illustrates the 3-dimensional undercrown surface area $A_{u3D}$ of the piston 10 shown in FIG. 6; and FIG. 9 illustrates the 2-dimensional surface area $A_{c2D}$ of the combustion bowl of the piston 10 shown in FIG. 6.

Further yet, the exposed area of the undercrown surface 24 typically has a diameter $D_u$, as shown in FIG. 7, ranging from 75 to 90 percent of the maximum outer diameter OD of the piston 10. The exposed area of the undercrown surface 24 can have a diameter $D_u$ ranging from 85 to 140 percent of the diameter $D_c$ of the combustion bowl, which is in contrast to a maximum of 100 percent for a piston having a closed or substantially closed cooling gallery.

However, the percentages of relative surface areas and relative diameters can vary from the ranges disclosed above while still providing for enhanced cooling. The percentages of relative surface areas and relative diameters of the exposed undercrown surface 24 of the piston 10 are far in excess of conventional pistons, and in some cases, are upwards to three times greater or more. As such, the upper combustion surface 16 can be cooled directly via oil splashing upwardly from the crankcase, which can be coupled with the assistance from oil jets, if desired.

As mentioned above, at least a portion of the undercrown pockets 50 of the piston 10 define at least a portion of the undercrown surface 24, as well as a portion of an underside of the first portion 18 and a portion of an inner surface of the annular ring belt 32. In the example embodiments, the undercrown pockets 50 together have a total 2-dimensional surface area $A_{p2D}$ ranging from 18 to 35 percent of the cross-sectional area $A_{OD}$ defined by the maximum outer diameter of the piston 10. The undercrown pockets 50 also have a total 3-dimensional area $A_{p3D}$ ranging from 50 to 85 percent of the cross-sectional area $S_{OD}$ defined by the maximum outer diameter of the piston 10. An example of the 3-dimesnional area $A_{p3D}$ of the undercrown pockets 50 is also shown in FIG. 8.

However, it is noted that the 2-dimensional and 3-dimensional surface areas of the undercrown pockets 50 can vary from the ranges disclosed above while still being able to contribute significantly to the cooling of the regions of the upper combustion surface 16 located directly above the pockets 50.

Another significant aspect of the example pistons 10 shown in FIGS. 1-11 is that at least a center portion 52 of the undercrown surface 24 of the piston 10 disposed between the opposite skirt panels 38 and the opposite pin bosses 38 is concave in form, when viewing from the bottom of the piston 10. As such, oil is channeled during reciprocation of the piston 10 from one side of the piston 10 to the opposite side of the piston 10, thereby acting to further enhance cooling of the piston 10. This concave portion 52 has a length extending longitudinally between the skirt panels 38 and a width extending between the pin bosses 38. The length of the concave portion 52 is typically greater than the width. In the example embodiments, the radius of curvature of the concave portion 52 ranges from 30 to 500 mm. Also, in the example embodiments shown in FIGS. 2 and 5-9, the concave portion 52 is axially offset from the pockets 50 or other surrounding area of the undercrown surface 24. For example, the concave portion 52 can be disposed closer to the pin bosses 38 than the surrounding area.

Figure 12:
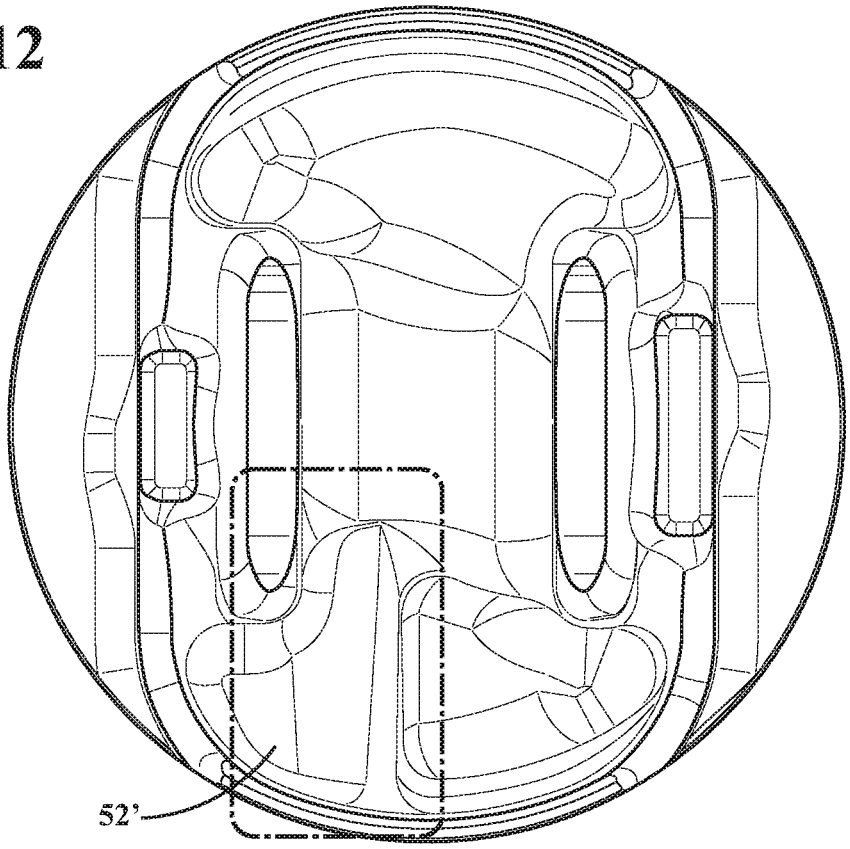
FIG. 12 is a bottom perspective view of a piston constructed in accordance with yet another example embodiment of the invention, wherein the piston includes a concave portion axially offset from a central axis of the piston.

FIG. 12 illustrates a piston 10' with an enhanced undercrown surface 24' according to another example embodiment. In this embodiment, the piston 10' includes a concave portion 52' which is axially offset from the central longitudinal axis 30' of the piston 10'. This offset concave portion 52' can be used in place of, or in addition to, the concave portion 52.

Figure 13:
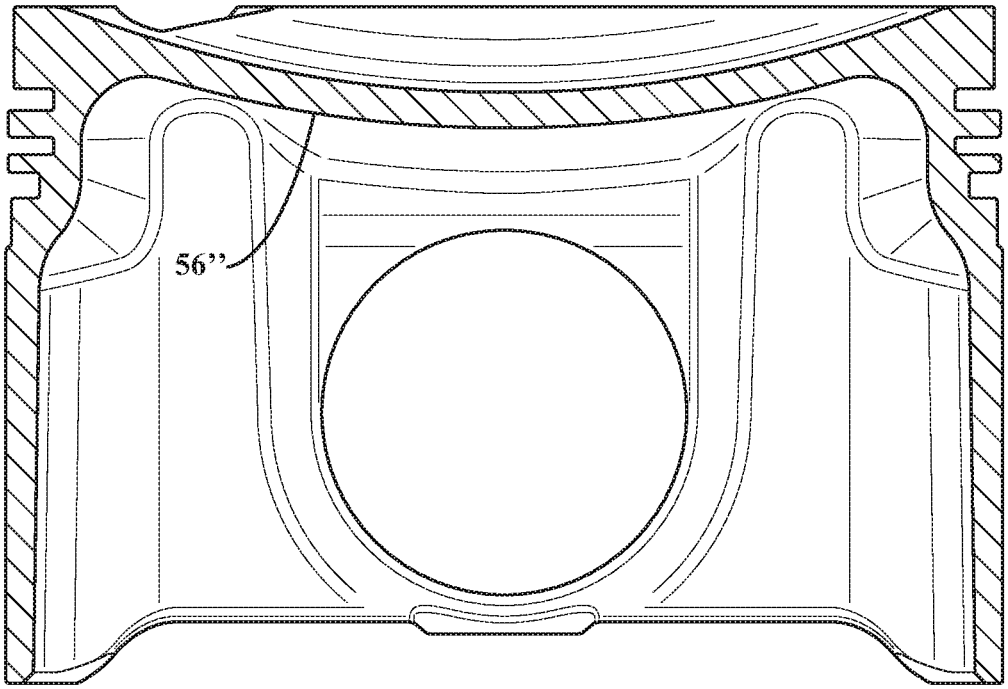
FIG. 13 is a side cross-sectional view of a piston constructed in accordance with yet another example embodiment of the invention which includes a convex portion.

FIG. 13 illustrates yet another example piston 10" with an enhanced undercrown surface area 24". In this embodiment, the undercrown surface 24" includes a convex portion 56" disposed along the central longitudinal axis 30" of the piston 10" to channel oil during reciprocation of the piston 10". In the example embodiment, the convex portion 56" extends continuously along the entire undercrown surface 24" between the opposite skirt panels 38". However, the convex portion 56" could be located along only a portion of the undercrown surface 24", either at the central longitudinal axis or axially offset from the central longitudinal axis 30". The radius of curvature of the convex portion 56" typically ranges from 80 to 300 mm.

Many modifications and variations of the present invention are possible in light of the above teachings. It is, therefore, to be understood that the invention may be practiced otherwise than as specifically described, and that the scope of the invention is defined by any ultimately allowed claims.

What is claimed is:

1. A piston for an internal combustion engine, comprising:

a piston body extending along a central longitudinal axis;

said piston body having an upper wall forming an upper combustion surface and an annular ring belt depending from said upper combustion surface;

said upper combustion surface having first and second portions, said first portion extending annularly along an outer periphery of said upper wall and said second portion forming a combustion bowl depending radially inwardly from said first portion;

said upper wall having an undercrown surface formed on an underside thereof, said undercrown surface located opposite said second portion of said upper combustion surface and radially inwardly of said ring belt;

said piston body including a pair of skirt panels depending from said ring belt;

said piston body including a pair of pin bosses spaced from one another by said skirt panels and providing a pair of laterally spaced pin bores;

said piston body being free of a cooling gallery along said undercrown surface;

said undercrown surface of the upper wall located opposite said second portion of said upper combustion surface and radially inwardly of said ring belt having an exposed 2-dimensional surface area, as viewed looking along said central longitudinal axis, ranging from 25 to 60 percent of a cross-sectional area defined by a maximum outer diameter of said piston body;

said undercrown surface being curved at said central longitudinal axis; and said piston body including undercrown pockets located radially outwardly of said pin bosses, at least a portion of said undercrown pockets forming at least a portion of said undercrown surface, and said undercrown pockets having a total 2-dimensional surface area ranging from 18 to 35 percent of said cross-sectional area defined by said maximum outer diameter of said piston body.

2. The piston of claim 1, wherein said 2-dimensional surface area of said undercrown surface ranges from 30 to 55 percent of said cross-sectional area defined by said maximum outer diameter of said piston body.

3. The piston of claim 1, wherein said 2-dimensional surface area of said undercrown surface ranges from 50 to 125 percent of a 2-dimensional surface area of said combustion bowl.

4. The piston of claim 1, wherein said 3-dimensional surface area of said undercrown surface ranges from 50 to 120 percent of a 3-dimensional surface area of said combustion bowl.

5. The piston of claim 1, wherein said undercrown surface has a diameter ranging from 85 to 140 percent of a diameter of said combustion bowl.

6. The piston of claim 1, wherein said undercrown surface has a diameter ranging from 75 to 90 percent of said maximum outer diameter of said piston body.

7. The piston of claim 1, wherein said undercrown surface has a 3-dimensional surface area ranging from 30 to 90 percent of said cross-sectional area defined by said maximum outer diameter of said piston body.

8. The piston of claim 1, wherein said undercrown pockets have a total 3-dimensional surface area ranging from 50 to 85 percent of said cross-sectional area defined by said maximum outer diameter of said piston body.

9. The piston of claim 1, wherein said portions of said undercrown pockets forming said portion of said undercrown surface is located opposite said second portion of said upper combustion surface and radially inwardly of said ring belt and at a distance of not greater than 10 mm from said upper combustion surface.

10. The piston of claim 1, wherein said undercrown surface includes a concave portion located along said central longitudinal axis.

11. The piston of claim 10, wherein a length of said concave portion is greater than a width of said concave portion.

12. The piston of claim 10, wherein said concave portion has a radius of curvature ranging from 30 to 500 mm.

13. The piston of claim 1, wherein said undercrown surface includes a concave portion axially offset from said central longitudinal axis.

14. The piston of claim 13, wherein said concave portion has a radius of curvature ranging from 30 to 500 mm.

15. The piston of claim 1, wherein said undercrown surface includes a convex portion located along said central longitudinal axis.

16. The piston of claim 15, wherein said convex portion has a radius of curvature ranging from 80 to 300 mm.

17. The piston of claim 1, wherein said upper wall has a thickness extending from said combustion surface to said underside of said upper wall, said undercrown surface is located along said underside at a distance away from said combustion surface, and said distance is no more than two times a minimum thickness of said upper wall.

18. The piston of claim 1, wherein said undercrown surface is located along said underside of said upper wall at a distance away from said upper combustion surface, and said distance is not greater than 10 mm.

* * * * *